United States Patent [19]

Markey et al.

[11] Patent Number: 4,501,103

[45] Date of Patent: Feb. 26, 1985

[54] BUILDING CONSTRUCTION AND PURLIN HANGER THEREFOR WITH METHOD OF CONSTRUCTION

[75] Inventors: Dennis P. Markey, West Bloomfield; George J. Rosen, Franklin, both of Mich.

[73] Assignee: Marco Wood Products, Inc., Walled Lake, Mich.

[21] Appl. No.: 540,770

[22] Filed: Oct. 11, 1983

Related U.S. Application Data

[62] Division of Ser. No. 360,078, Mar. 3, 1982, Pat. No. 4,425,742.

[51] Int. Cl.[3] ..... E04B 1/00

[52] U.S. Cl. ..... 52/745; 52/86; 52/90; 52/127.2

[58] Field of Search ..... 52/86, 90, 712, 127.2, 52/741, 745

[56] References Cited

U.S. PATENT DOCUMENTS 3,365,222 1/1968 Polyak ..... 52/712 X 4,115,967 9/1978 Kragt ..... 52/90

*Primary Examiner*—J. Karl Bell

*Attorney, Agent, or Firm*—Harness, Dickey & Pierce

[57] ABSTRACT

A building construction comprised of front and rear planar supports having purlins spanning between the supports and attached to the supports by hangers attached to the outside surfaces of the supports, i.e. the surface of the support opposite the surface generally adjacent to the purlin. The hanger comprises a seat to which each purlin is connected, and two arms integrally secured to the seat. The arms include integrally formed nails which attach to the surface opposite the surface adjacent to the seat portion of the hanger. Notches are included at the periphery of the support through which the arms of the hangers are hung. The method of construction involves setting up a floor, attaching and bracing the planar supports, hanging and attaching the purlins, taking away the braces, and adding the roof, sidewalls, and the other parts to provide a building construction to be used as a storage hut or the like.

2 Claims, 10 Drawing Figures

BUILDING CONSTRUCTION AND PURLIN HANGER THEREFOR WITH METHOD OF CONSTRUCTION

This is a division of application Ser. No. 360,078, filed Mar. 3, 1982, now Pat. No. 4,425,742.

BACKGROUND AND SUMMARY OF THE INVENTION

The present invention relates generally to easy to construct building assemblies and particularly to an improved assembly utilizing an improved joist or purlin hanger in construction of the building.

Relatively small, easy to construct buildings, commonly called sheds, huts, shanties, shelters, or the like, have been desirable throughout the ages of man for protective storage of implements, small vehicles, animals, and many other things which do not require the full level of comfort of a house with its attendant features of heating, plumbing, etc. To be useful, such buildings must be sturdy, be able to withstand a variety of weather conditions, and generally be capable of having a long life with a minimum of upkeep. It also has been generally desirable for such buildings to maintain a relatively aesthetically appealing appearance with a minimum of maintenance. By far the most important feature, however, is ease of construction so that a person of even limited mechanical aptitude or craftsmanship may construct the building in a minimum of time and effort.

Accordingly, one object of the present invention resides in the provision of a building assembly requiring a minimum of time and effort to build even if the builder has minimal mechanical aptitude or craftsmanship ability. It is a further object to provide the ease of construction to result in a sturdy and weather-resistant structure, generally capable of long life with a minimum of upkeep.

Hinged wooden doors are desirable to use in such a hut construction due to simplicity of construction and low costs. Such doors, however, have problems with racking. Accordingly, it is a further object of the present invention to provide a door design for the present construction to reduce the likelihood that racking occur and maintain a functionally and aesthetically appealing structure.

BRIEF DESCRIPTION OF THE DRAWINGS

FIG. 2 is an elevated perspective view of the building of FIG. 1 at an intermediate stage of construction;

FIG. 5 is an enlarged partial view of the construction of FIG. 2 illustrating the hanger, purlin, and planar support in operable association;

DESCRIPTION OF THE PREFERRED EMBODIMENT

Figure 1:
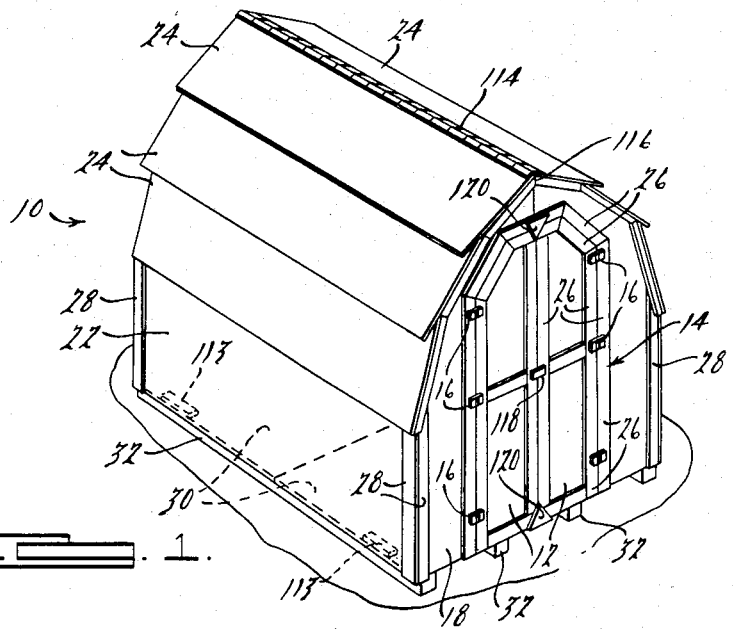
FIG. 1 is an elevated perspective view of the finished building of the present invention.
Figure 3:
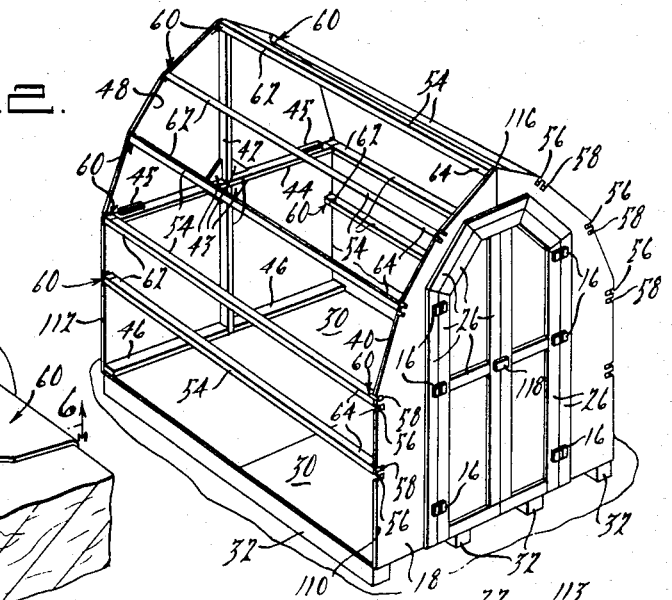
FIG. 3 is an elevated perspective view of the building of FIG. 1 at an intermediate stage of construction prior to that shown in FIG. 2.
Figure 2A:
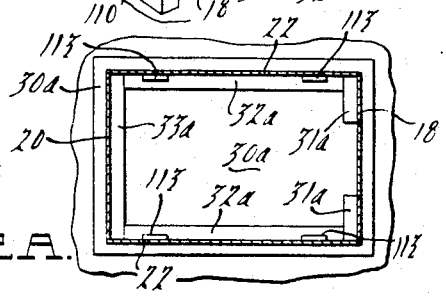
FIG. 2*a* is an elevated top view of an alternative floor to be used with the building of FIG. 1.
Figure 3:
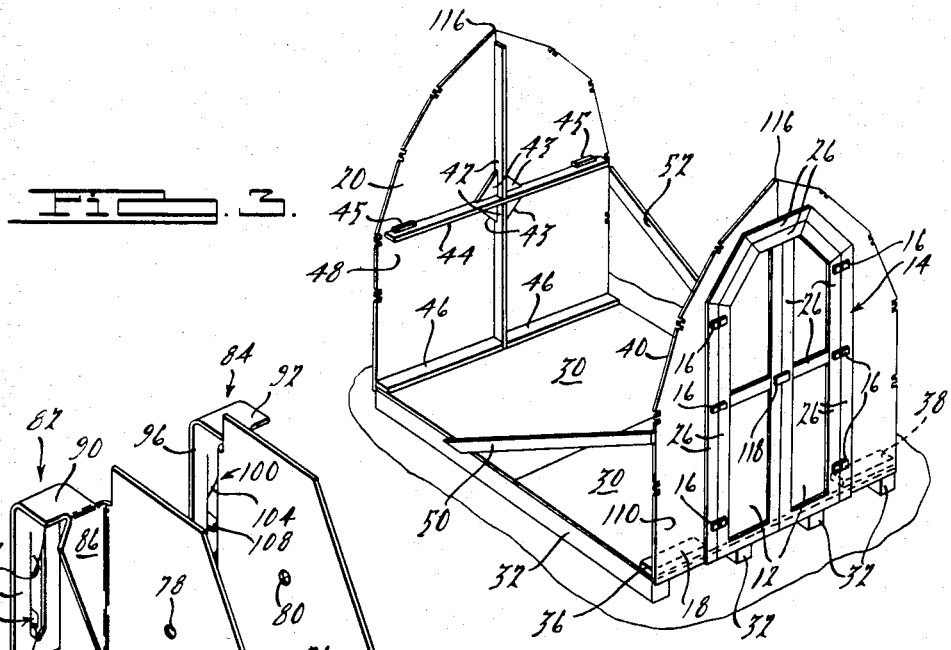
Figure 4:
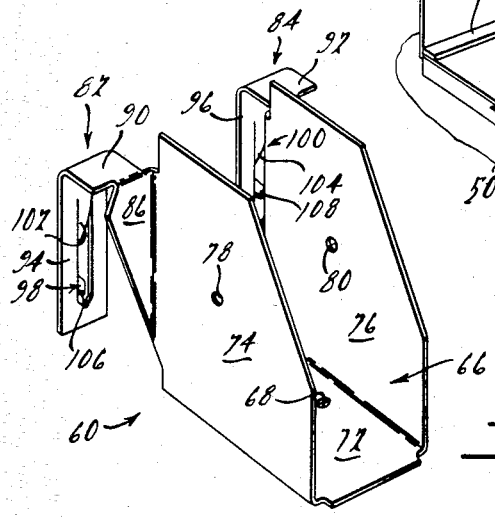
FIG. 4 is a perspective view of a joist hanger of the present invention.

Referring to FIGS. 1, 2 and 3, a building construction 10 within the scope of the present invention is illustrated. FIG. 1 illustrates the building 10 as constructed in its final form. Included in the finished building 10 are doors 12 mounted on hinges, generally designated 16, indoor frame 14, front 18 and rear 20 supports, each comprised of two sections, designated 18*a* and 18*b* and 20*a* and 20*b*, respectively, generally planar in configuration and hereinafter called walls with respect to the preferred embodiment, side wall members 22, roof panels 24, door and door frame trim 26, edge trim 28, and a plywood floor 30 on floor joists 32. Alternatively, the floor 30*a* may be a concrete slab with locator cleats 31*a*, 32*a*, and 33*a* located either adjacent the inside surfaces of the walls 18, 20, and 22 (FIG. 2*a*) or supporting them from below, or any other arrangement as known in the art.

Figure 8:
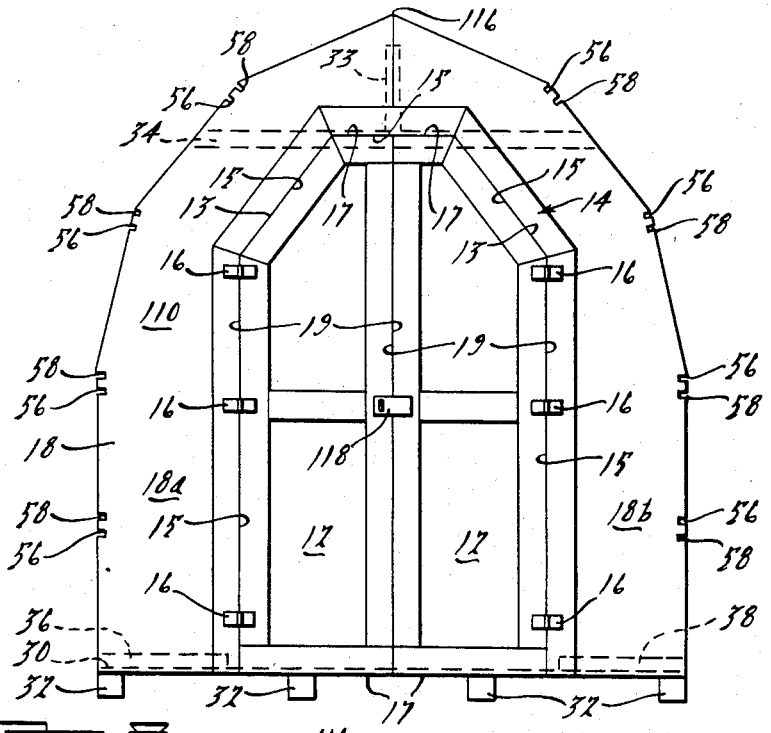
FIG. 8 is an elevated front view of the front wall of the building of FIG. 1.
Figure 9:
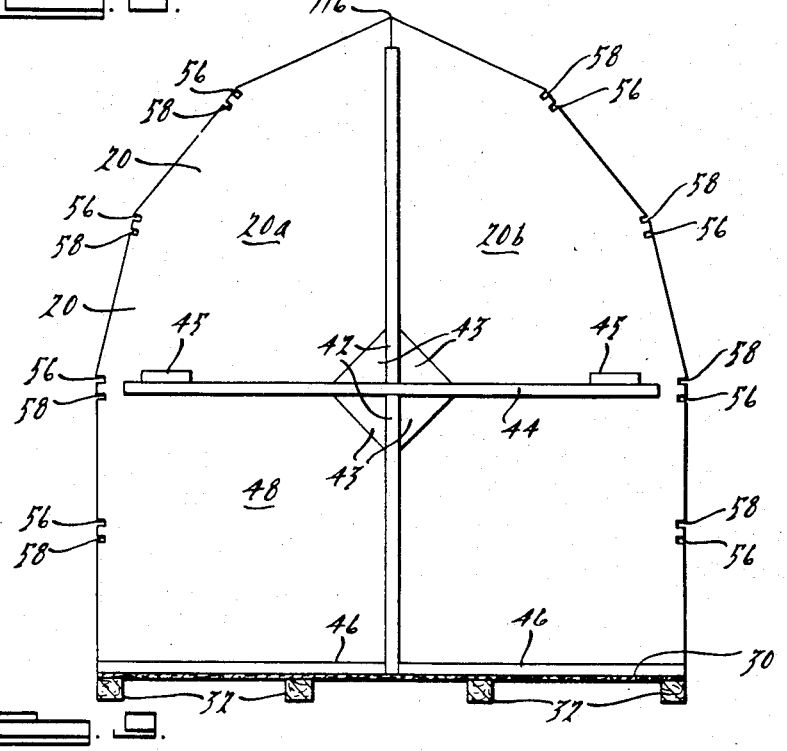
FIG. 9 is an elevated front view of the rear wall of the building of FIG. 1.

FIGS. 2 and 3 illustrate the building 10 in intermediate stages of construction. Initially, the floor 30 is secured to the joists 32. The front wall sections 18*a* and 18*b* are connected at support member 33 (FIG. 8), and a door stop 34 and locator members 36 and 38 are attached to the inner surface 40 of the front wall 18, as shown in FIG. 8, after the doors 12 and 14 have been cut out and attached by hinges 16. The door and door frame trim 26 may be added at any time, but is usually preassembled on said front wall 18 or added prior to cutting out and hinging the doors. Rear wall sections 20*a* and 20*b* are secured together by vertical 42 and horizontal 44 braces secured to the inner surface 48 of the rear wall 20, as shown in FIG. 8. The vertical 42 and horizontal 44 braces are aligned by four triangular shaped locator members, generally designated 43, and horizontal locator blocks 45, all of which are usually preassembled on said rear wall sections 20*a* and 20*b*. Floor locator members 46 are likewise secured to said rear wall 20 as shown in FIG. 9. The front wall 18 is then attached to the floor 30 and a brace 50 is temporarily secured between the floor 30 and the wall 18. The procedure is then repeated for the rear wall 20 and the temporary brace 52 to arrive at the construction shown in FIG. 3. In the preferred embodiment, the locator members 36, 38, and 46 locate the front wall 18 and rear wall 20 in an overlapping relationship with the floor 30 to decoratively cover the outer edges of the floor 30.

The doors 12 each have five sides including a diagonal or canted upper portion 13 in the preferred embodiment. The diagonal portions 13 keep the doors 12 from racking to remain both more functionally and aesthetically appealing, while also having spaced apart horizontal 17 and vertical edges 19 to align the doors conventionally and utilize conventional hinges 16, as shown in FIG. 8. The door frame 14 has edges 15 parallel to each of said door edges 13, 17, and 19. The diagonal portions 13 of the doors 12 meet the hinged vertical edges 19 of the doors 12 above the uppermost of the hinges 16 and generally form an angle of thirty to sixty degrees with the line formed with a horizontal edge 17 of the door 12.

The next step involves hanging the purlins, generally designated 54, from the front wall 18 to the rear wall 20. Referring to FIGS. 8 and 9, pairs of notches 56 and 58 are located at spaced intervals along the periphery of front wall 18 and rear wall 20, respectively. Purlin hangers 60 are attached to both ends 62 and 64 of each purlin 54 and are inserted in the notches 56 and 58 to properly locate and attach the purlins 54 along the periphery of the front 18 and rear 20 walls. The braces 50 and 52 are removed after the purlins 54 have been hung. At the peak 116, a purlin 54 is hung from the top of vertical brace 42 on the rear wall 20 to the top of support member 33 on the front wall 18 and secured by suitable nail fasteners, although a notch and hanger arrangement could readily be utilized.

The hangers 60, referring to FIGS. 4, 5, 6, and 7, are preferably a one-piece sheet metal construction having a seat 66 which has means, such as apertures 68 and 70 in bottom section 72 (FIG. 7), through which the hanger 60 can be secured to a purlin 54 by a suitable fastener, such as a conventional nail. Sidewalls or flanges 74 and 76 extend upwardly generally perpendicularly from the bottom section 72 to form the seat 66. The flanges 74 and 76 also have means, such as apertures 78 and 80, respectively, to additionally secure the hanger 60 to the purlin 54 by a suitable fastener, such as nail 79. C-shaped arms 82 and 84 are integrally attached to the flanges 74 and 76 of the seat 66. Support flanges 86 and 88 extend generally perpendicularly from the sidewalls 74 and 76, respectively, from which top sections 90 and 92 extend. Attachment flanges 94 and 96 extend downwardly and substantially perpendicularly from said top sections 90 and 92 respectively. The top sections 90 and 92 extend to form surfaces in substantially the same plane, substantially parallel with the plane formed by the bottom section 72, and generally perpendicularly from the plane formed by the support flanges 86 and 88. Attachment flanges 94 and 96 extend substantially parallel to the plane formed by support flanges 86 and 88. Top sections 90 and 92 engage the notches 56 and 58 when the hanger 60 is located in its proper position. Nails 98 and 100 are integrally formed within the flanges 94 and 96 respectively. The nails 98 and 100 are comprised of head flanges 102 and 104, respectively, and generally perpendicularly situated nail point flanges 106 and 108.

Figure 6:
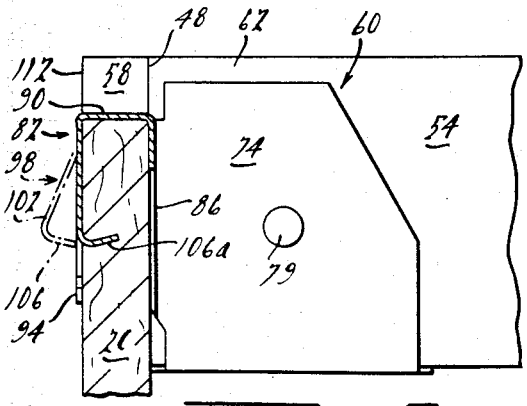
FIG. 6 is a sectional view of the construction of FIG. 5 along the line 6—6.
Figure 7:
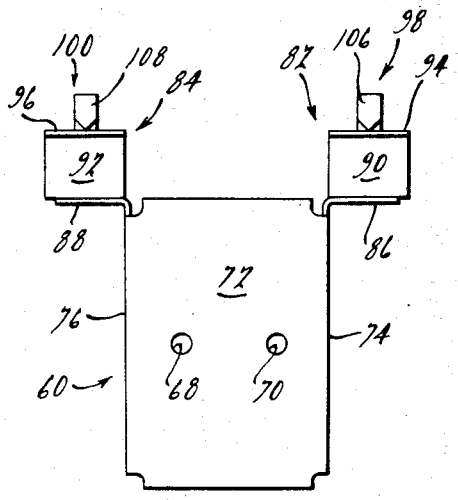
FIG. 7 is a bottom view of the joist hanger of FIG. 4.

One hanger 60 is attached to each end 62 and 64 of purlin 54 by suitable fasteners and the purlin 54 is located as a span between the front 18 and rear 20 walls by the insertion of the top sections 90 and 92 of the arms 82 and 84 of the hanger 60 into the notches 56 and 58 at the periphery of the front and rear walls 18 and 20. Attachment flanges 94 and 96 will then be located adjacent the outer surface 110 of front wall 18 or the outer surface 112 of rear wall 20. The purlin 54 and hanger 60 are secured by driving nail point flanges 106 and 108 through the associated outer surface into engagement with the associated front or rear wall 18 or 20, as illustrated in FIG. 6 by nail point flange 106*a*.

After all of the purlins 54 are secured, referring to FIG. 1, the sidewall members 22 are attached. The sidewalls 22 have locator members 113 at the lower portions thereof (FIG. 1) to locate the sidewalls 22 in an overlapping relationship with the floor 30 to decoratively cover the outer edges of the floor 30. The roof panels 24 are then attached and edge trim 28 is added. The edge trim 28 will cover the attachment flanges 94 and 96 of the hangers 60, which would otherwise be exposed, and will provide an aesthetically appealing appearance. The roof panels, walls, and trim are preferably made of wood and may be painted or stained at any time in the construction process, either before or after mounting. Ridge shingles 114 may be added at the peak 116 of the roof to provide a better weather seal at that point and a more aesthetically pleasing appearance. Attachment of a conventional door latch 118 and outer door stops 120 (FIG. 1) generally completes the construction of the building.

The purlin hanger arrangement of the present invention is particularly noteworthy for its elimination of any rafters or the like attached to the inner surfaces of the periphery of front and end walls 18 and 20. Roof support frames having cross joists are also not necessary with the construction of the present invention, but may be readily added is so desired and the hanger 60 of the present invention may also be used to support the joists or rafters between the purlins 54.

While it will be apparent that the preferred embodiment disclosed is well calculated to fulfill the objects above stated, it will be appreciated that the invention is susceptible to modification, variation, and change without departing from the proper scope or fair meaning of the subjoined claims.

What is claimed is:

1. A method for constructing a storage hut comprising front and rear walls, each said wall having an interior surface and an exterior surface, purlins, hanger means to attach said purlins to said walls, said hanger means including means for attachment to the exterior surface of one of said walls, floor means, means for locating said walls on said floor means, means for attaching said walls to said floor means, and brace means for bracing said walls to said floor, which comprises the steps of:

preparing the floor means;

attaching the walls to the floor and bracing the walls by connecting said brace means between the floor means and each wall;

attaching hanger means to each end of said purlins:

attaching said purlins to the exterior surfaces of said walls by said hanger means; and removing said brace means.

2. A method for constructing a storage hut comprising front and rear walls, each said wall having an interior surface and an exterior surface, purlins, hanger means for locating said purlins on said walls, means for locating each said hanger means on each said wall, means for attaching each said purlin and hanger means to one of said walls comprising means insertable into said wall from the exterior surface of one of said walls, floor means, means for locating said walls on said floor means, means for attaching said walls to said floor means, and brace means for bracing said walls to said floor, which comprises the steps of:

preparing the floor means;

attaching the walls to the floor and bracing the walls by connecting said brace means between the floor means and each wall;

attaching hanger means to each end of said purlins:

locating each of said purlins on each of said walls by said hanger locating means;

attaching each said purlin and hanger means to one of said walls by means of attaching means into said wall from the exterior surface of said wall; and removing said brace means.

* * * * *